US010750793B1

(12) United States Patent
Theodoridis

(10) Patent No.: US 10,750,793 B1
(45) Date of Patent: Aug. 25, 2020

(54) UNDERGARMENT SUITED FOR REDUCING THE APPEARANCE OF SWEAT

(71) Applicant: Wearable Confidence, LLC, San Francisco, CA (US)

(72) Inventor: Konstantine Igor Theodoridis, San Francisco, CA (US)

(73) Assignee: Wearable Confidence, LLC, San Francisco, CA (US)

( * ) Notice: Subject to any disclaimer, the term of this patent is extended or adjusted under 35 U.S.C. 154(b) by 0 days.

(21) Appl. No.: 15/950,961

(22) Filed: Apr. 11, 2018

Related U.S. Application Data

(60) Provisional application No. 62/485,157, filed on Apr. 13, 2017.

(51) Int. Cl.
*A41B 9/12* (2006.01)
*A41B 9/00* (2006.01)
*A41B 9/02* (2006.01)

(52) U.S. Cl.
CPC ..... *A41B 9/12* (2013.01); *A41B 9/001* (2013.01); *A41B 9/004* (2013.01); *A41B 9/005* (2013.01); *A41B 9/02* (2013.01); *A41B 2400/34* (2013.01)

(58) Field of Classification Search
CPC ..... A41B 9/12; A41B 9/001; A41B 9/004; A41B 9/005; A41B 9/02; A41B 2400/34
See application file for complete search history.

(56) References Cited

U.S. PATENT DOCUMENTS 2,255,931 A * 9/1941 Kloster ..... A41B 9/02 2/404
2,459,043 A * 1/1949 Owenby ..... A41B 9/02 2/401
2,711,542 A * 6/1955 Rosenberg ..... A41B 9/04 2/407
3,083,710 A * 4/1963 Rauser ..... A41B 9/02 602/67
3,220,410 A * 11/1965 Sloan ..... A41B 9/02 602/67
3,279,469 A * 10/1966 Schustack ..... A41C 1/003 450/113
3,763,866 A * 10/1973 Bienenfeld ..... A41B 9/02 450/134
4,880,424 A * 11/1989 Rautenberg ..... A61F 13/66 604/396
8,898,812 B2 12/2014 Thompson et al.
9,205,965 B2 * 12/2015 Vanlandingham ... B65D 75/008
2006/0070163 A1 * 4/2006 Beck ..... A41B 9/001 2/69
2007/0079427 A1 * 4/2007 Herbert ..... A41B 9/00 2/403

(Continued)

FOREIGN PATENT DOCUMENTS

WO 2004089614 A2 10/2004

OTHER PUBLICATIONS

Petition for Inter Partes Review of U.S. Pat. No. 8,898,812 Case IPR 2017-01529, dated Jun. 6, 2017, 52 pages.

(Continued)

*Primary Examiner* — Khaled Annis

(74) *Attorney, Agent, or Firm* — HIPLegal LLP; Judith Szepesi

(57) ABSTRACT

An undergarment including one or more sweat-curtailing portions designed to provide protection against the appearance of sweat and eliminate odor.

20 Claims, 10 Drawing Sheets

(56) References Cited

U.S. PATENT DOCUMENTS

2008/0052802 A1 3/2008 Bryan
2008/0096001 A1 4/2008 Emden et al.
2008/0114327 A1* 5/2008 Barge ..... A41B 9/12 604/396
2009/0300826 A1* 12/2009 Harimoto ..... A41B 9/02 2/403
2011/0023216 A1* 2/2011 O'Leary ..... A41B 9/001 2/400
2013/0066288 A1* 3/2013 Lin ..... A61F 13/51113 604/360
2014/0039432 A1* 2/2014 Dunbar ..... A61F 13/49003 604/360
2014/0053322 A1* 2/2014 Zamler ..... A41B 9/04 2/407
2014/0196196 A1* 7/2014 Lee ..... A41B 9/14 2/400
2014/0304899 A1* 10/2014 Almonte ..... A41B 9/001 2/403
2015/0351460 A1* 12/2015 Clement ..... A41B 9/001 2/400
2016/0135509 A1* 5/2016 Clement ..... A41B 9/001 2/400
2016/0278438 A1* 9/2016 Polidan ..... A41B 9/001
2018/0098582 A1* 4/2018 Bronzini Bedini ..... A41D 1/22
2018/0271176 A1* 9/2018 Harrell ..... A41B 9/12

OTHER PUBLICATIONS

Supporting Document from Inter Partes Request IPR 2017-01529, Declaration of Expert David Brookstein, Jun. 1, 2017, 30 pages.

* cited by examiner

UNDERGARMENT SUITED FOR REDUCING THE APPEARANCE OF SWEAT

RELATED APPLICATION

The present application claims priority to U.S. Provisional Application No. 62/485,157 filed on Apr. 13, 2017 and incorporates that application in its entirety.

FIELD

The present invention relates to undergarments, and more particularly to undergarments suited to reduce the appearance of sweat.

BACKGROUND

Sweating is a natural function of the human body, used to cool down. It is natural to sweat when one is nervous, or stressed, as well as upon exercise or other exertion. Others sweat because of medical conditions such as hyperhidrosis or because of medication they are prescribed. However, in today's world, sweat marks are considered unacceptable in many situations, especially in professional ones. It is inaccurately assumed that someone who has sweat marks on their clothes is nervous or unprepared and this affects their performance. Not only can the appearance of sweat be problematic, the smell cause by bacteria which is often found in moist areas of the body is off-putting, and not professionally acceptable.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

An undergarment suited to reduce the appearance of sweat and elimination of body odor is described. The undergarment may be an underwear, and may include undergarments such as undershirts. The undergarment is designed with a multi-layer sweat-curtailing solution which includes a layer to ensure that the exterior does not show any sweat marks, a material to ensure lack of scent, and a material to block and absorb sweat. In one embodiment, the layout of these materials is designed to minimize seams in areas in which sweat is likely. This improves functionality and appearance. Furthermore, in one embodiment, the design of the underwear includes an elongated waist area in which provides coverage for the lower back and some other zones which can show sweat while the design for the undershirt has extra length to ensure it remains tucked in, and provides coverage to the lower back/upper buttocks.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 1:
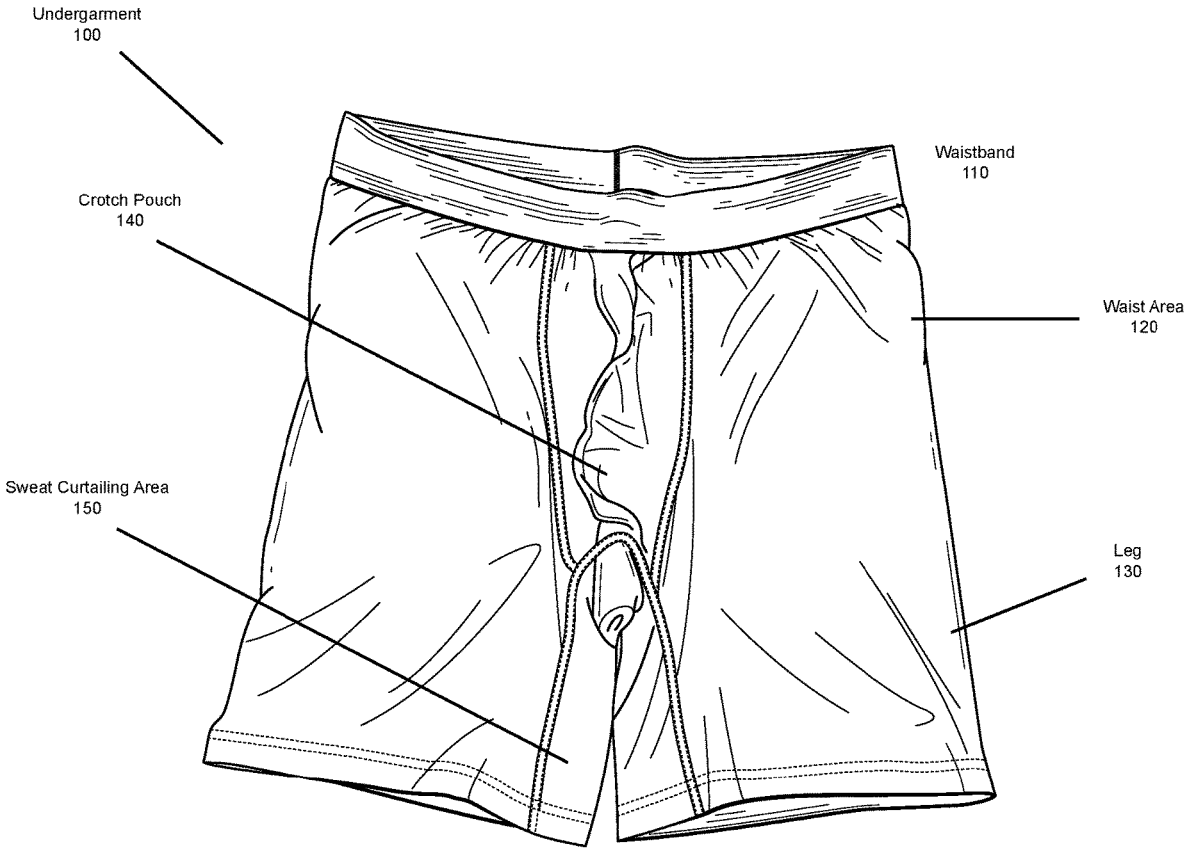
FIG. 1 is a front view of one embodiment of an underwear including a protective zone.

FIG. 1 is front view of a brief-style underwear. As can be seen, there are multiple panels which make up the underwear. It includes a waistband 110, a waist area 120, legs 130, and a pouch 140 for the wearer's genitals. The fabric utilized is stretchy to provide a comfortable fit. In one embodiment, the fabric is micro modal, which provides a very soft, but sturdy fabric. Micro modal is made from birch trees, is renewable, is twice as soft as cotton, and is 50% more absorbent. In one embodiment, the fabric may be bamboo, cotton, or other materials. In one embodiment, the fabric is made of a natural material. In one embodiment, the fabric has some spandex for added stretch. In one embodiment, the fabric has 2-15% spandex.

In one embodiment, as can be seen in FIG. 1, the front area of the briefs are generally only multi-layer between the legs 150, with the remaining portion being made of fabric only. This provides more flexibility and comfort. Because these are the areas where sweat accumulates, it also provides a high level of protection while being comfortable to wear.

Figure 2:
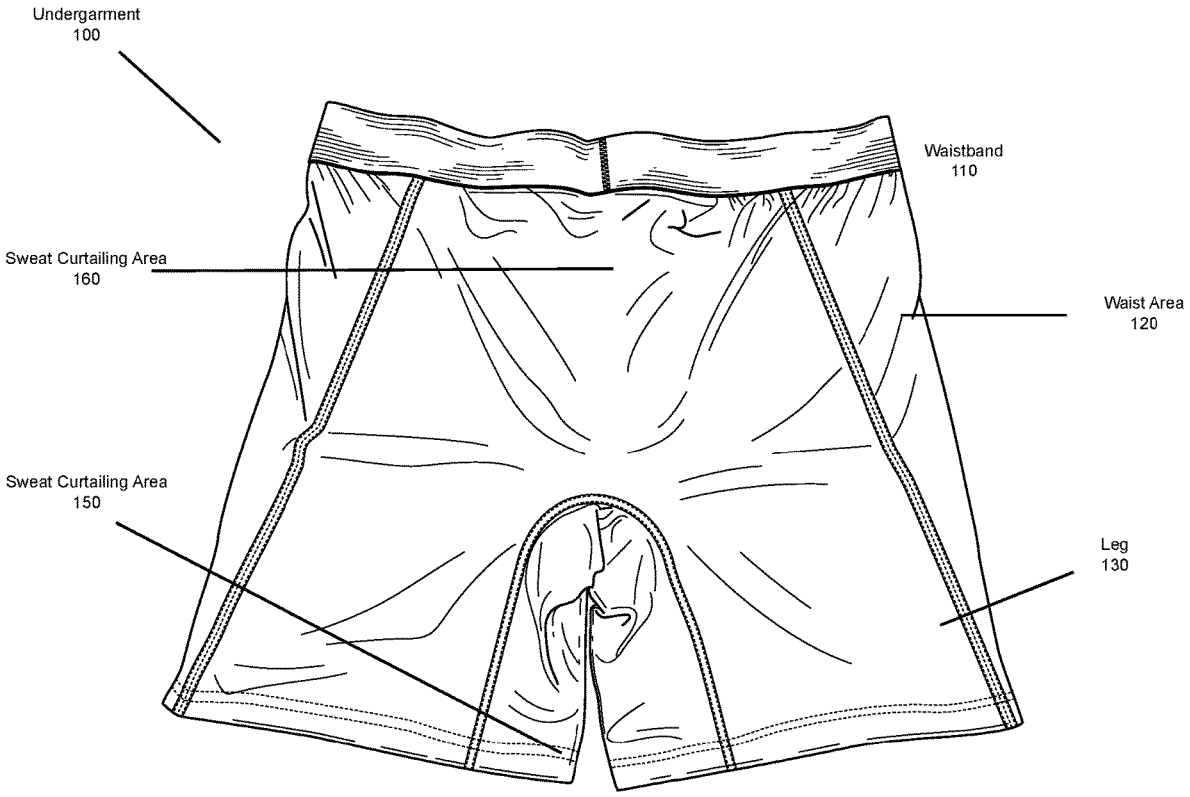
FIG. 2 is a back view of one embodiment of the underwear of FIG. 1, including a protective zone.

FIG. 2 shows one embodiment of the back of the briefs of FIG. 1. As can be seen, more of the back area 160 is covered, especially in the center back, where most people sweat. However, in one embodiment, the outsides of the legs 130 are single-layer fabric, to provide a smoother fit. The item is designed to appear as a normal garment under clothing, and to wear comfortably. Because the layer design is made specifically for undergarments, it is designed for repeated washing, and wearing. Because sweat tends to penetrate through seams, the design is made to minimize the seams in the areas where sweat is likely to occur. This provides a highly comfortable undergarment, which blocks the appearance and odor of sweat.

Figure 3:
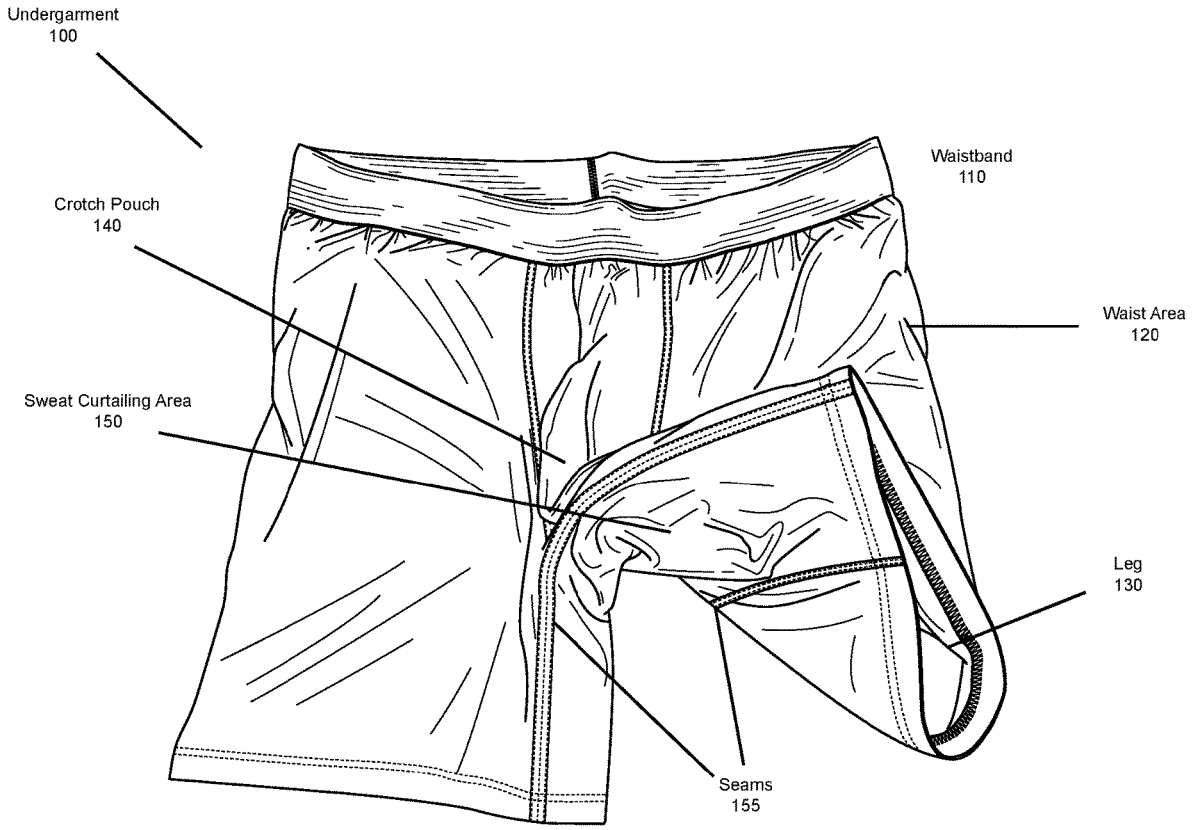
FIG. 3 is the front view of the underwear of FIG. 1, showing the area between the legs.

FIG. 3 shows one embodiment of the undergarment of FIG. 1 showing the area between the legs 130. As can be seen, in this area, which is often sweat-prone, there are fewer seams. Standard underwear has a seam across the center of the inside leg. Instead, this design has the seam 155 on either side of the inside thigh area 150. This not only increases comfort but also decreases the accumulation of sweat in the seams, which are hard to clean. Furthermore, moving such seams also decreases the risk that sweat will seep through the seams, and show on the user's exterior garments. In one embodiment, there are no seams at all in this area, it is made of a single (multilayer sweat-curtailing) piece.

Figure 4A:
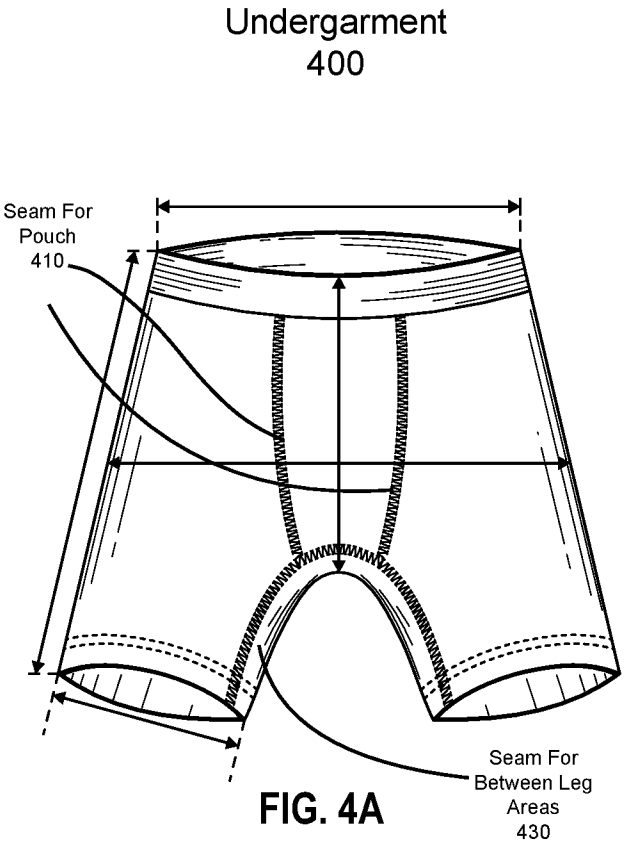
FIGS. 4A-4D show an assembly view of the elements of the underwear of FIG. 1.
Figure 4B:
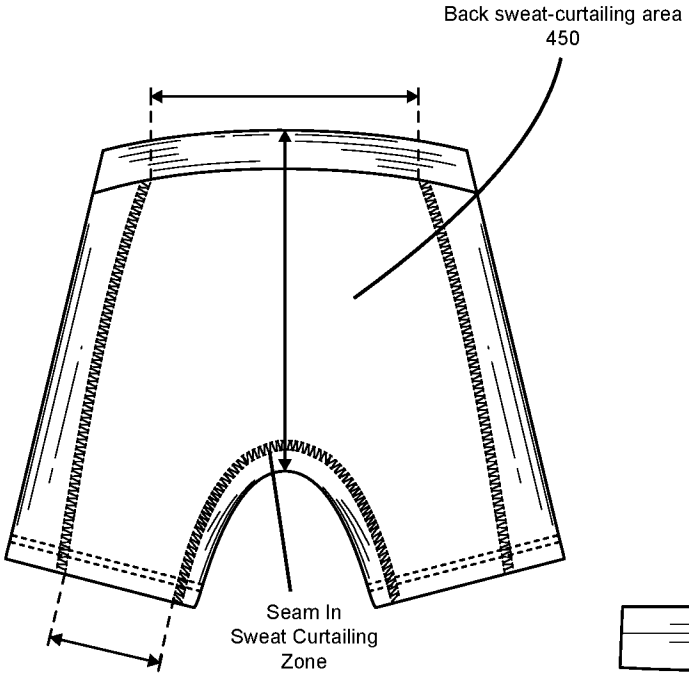
Figure 4C:
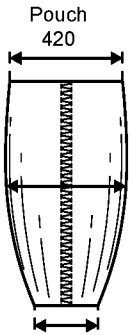
Figure 4D:
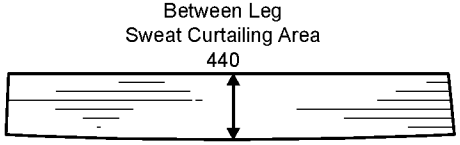

FIGS. 4A-4D show an assembly view of the elements of the underwear of FIG. 1. As can be seen, FIG. 4A shows the front view, showing relative dimensions, and showing the front including the seams 410, 430 where the genital pouch 420, shown as FIG. 4C, and the between leg area 440, shown as FIG. 4D are inserted. In one embodiment, the genital pouch 420 is made of two pieces stitched together to form the pouch shape. FIG. 4B shows the back of the same undergarment, with the seams showing the area which is the sweat-curtailing zone 450 in the back, and between the legs. In one embodiment, the sweat-curtailing zones include the area between the legs and the back of the undergarment. Thus, the only seam 460 in the sweat-curtailing zone is the seam between the rectangle of the portion between the legs (FIG. 4D) and the back area (FIG. 4B).

Figure 5:
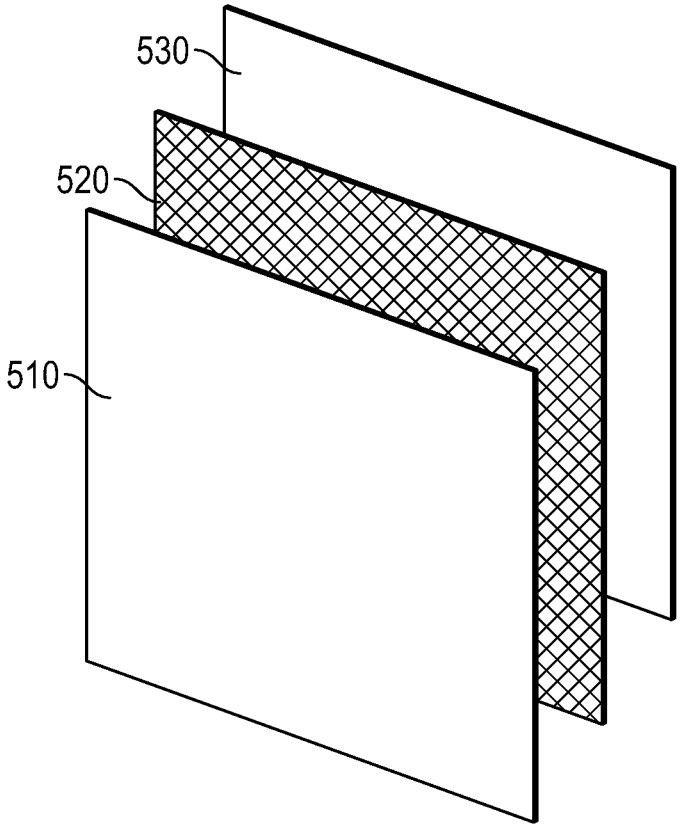
FIG. 5 is a cross-sectional view of the protective zone material.

FIG. 5 is a cross-sectional view of the protective zone material. As can be seen, in one embodiment there are three layers, an exterior layer 510, a middle waterproof layer 520, and an inner layer 530. In one embodiment, the exterior layer 510 is made of micro modal or a similar fabric material impregnated with antibacterial material. In one embodiment, the fabric is fused with silver, copper, or a cationic polymer. The middle layer is made of the polyurethane laminate fabric. In one embodiment, the middle layer is made of a Polyurethane laminate (PUL) waterproof film which is bonded to a backing material, forming the polyurethane laminate fabric. The polyurethane laminate fabric allows water vapor and heat to pass through, but is water proof. The inner layer is an absorbent material, in one embodiment micro modal also fused with an antibacterial material, to reduce bacterial growth, which produces the odor of sweat. The material may be impregnated by copper, in another embodiment. The material may be impregnated with a cationic polymer, or other material which is anti-bacterial. But reducing the bacteria on the skin and in the clothing, the odor of sweat can be eliminated or limited. In one embodiment, the seams for each sweat-curtailing area are minimized to reduce the chance that sweat would seep through a seam. In one embodiment, the material is double stitched.

Figure 6:
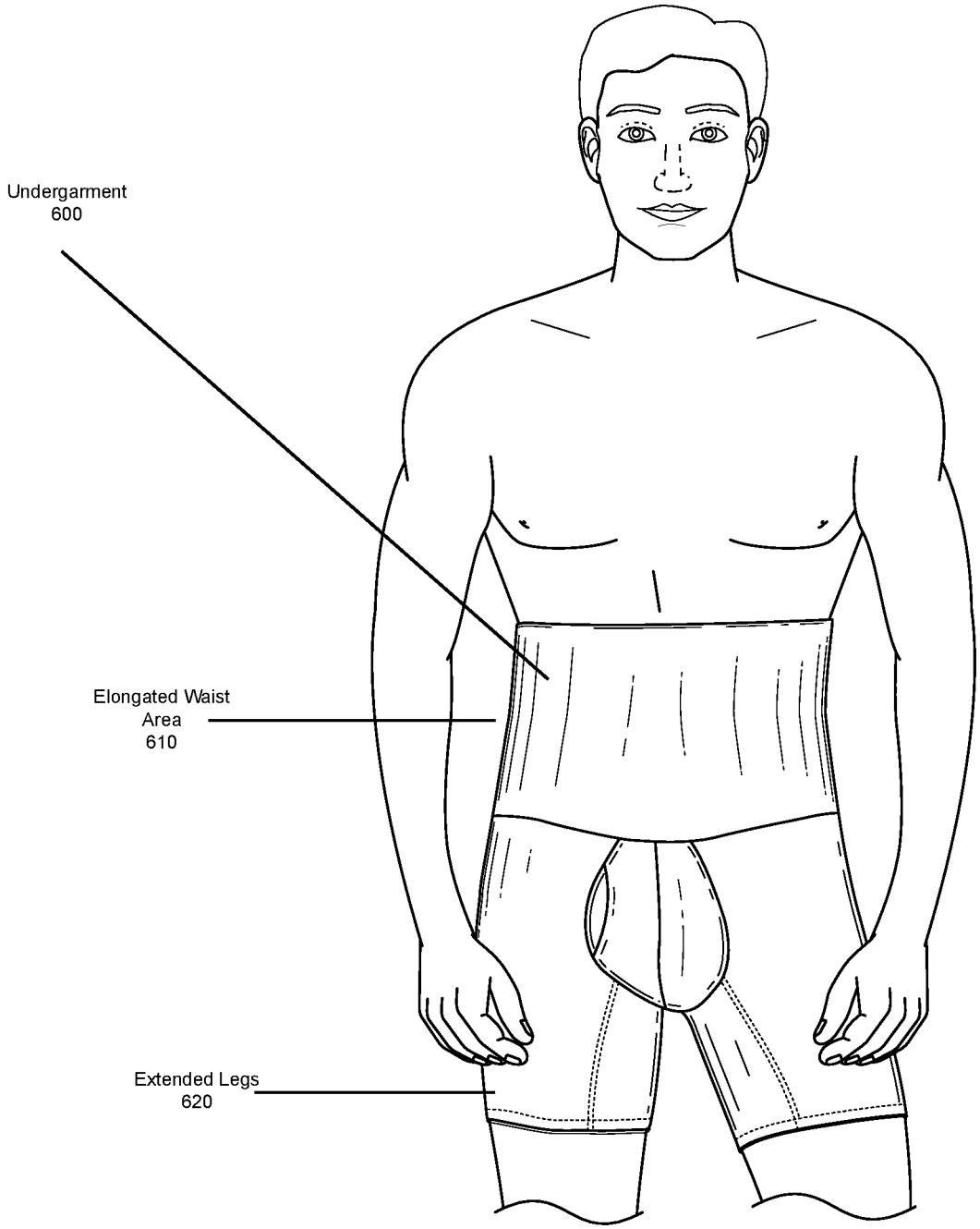
FIG. 6 is a front view of another embodiment of an underwear including a protective zone and an elongated waist area.
Figure 7:
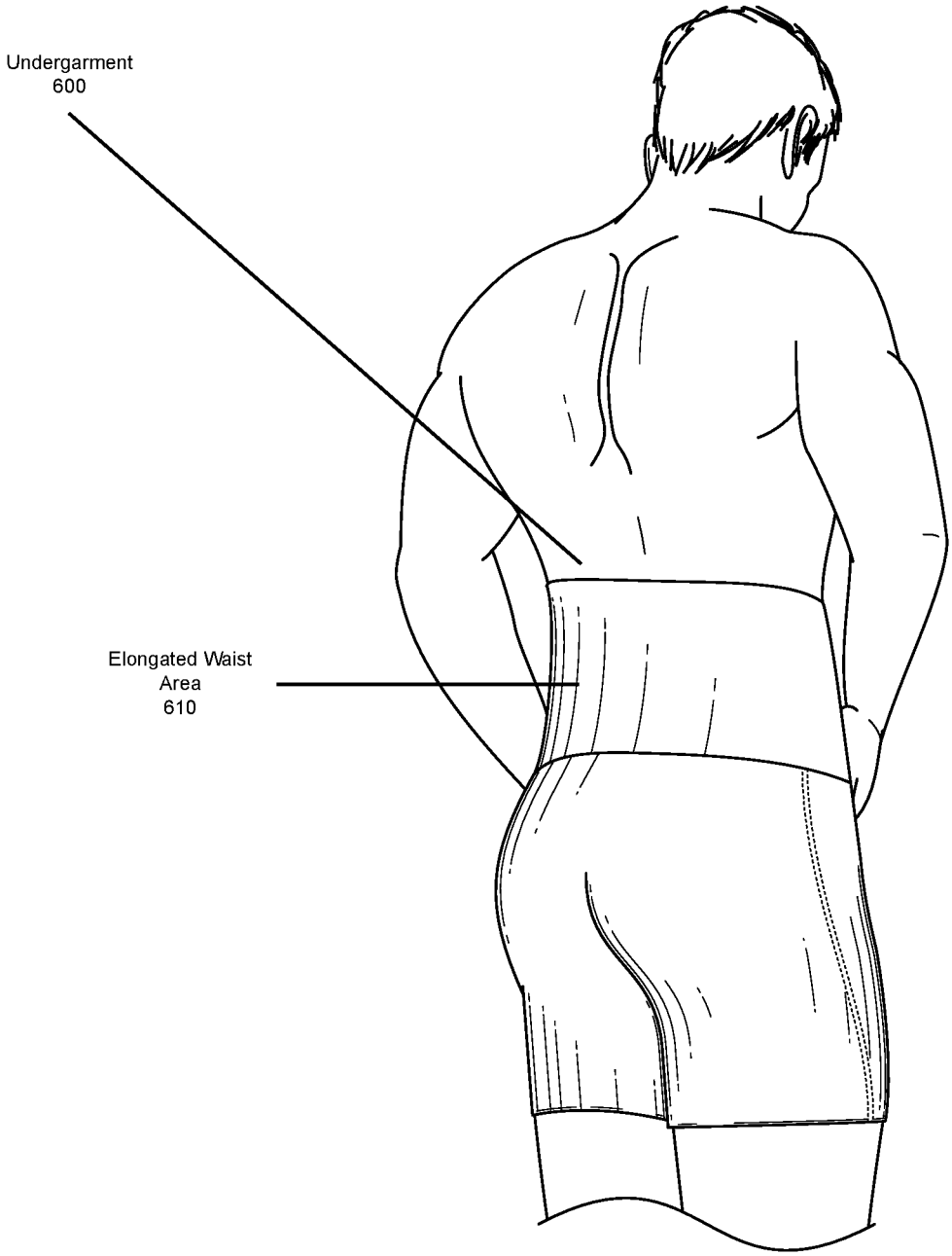
FIG. 7 is a back view of one embodiment of the underwear of FIG. 6.
Figure 8A:
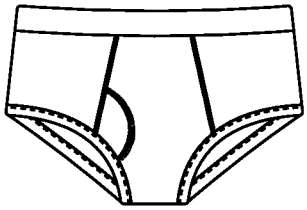
FIGS. 8A-8I illustrate some exemplary undergarments which may include the protective zones described.
Figure 8B:
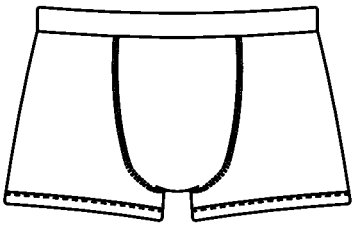
Figure 8C:
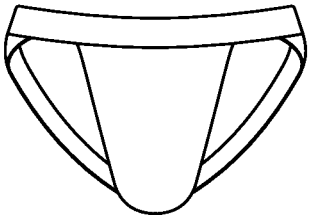
Figure 8D:
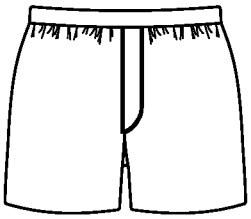
Figure 8E:
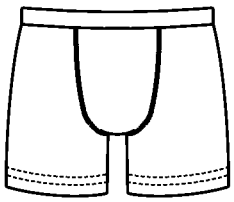
Figure 8F:
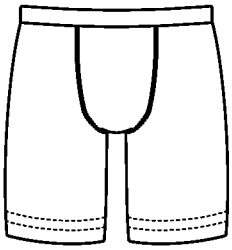
Figure 8G:
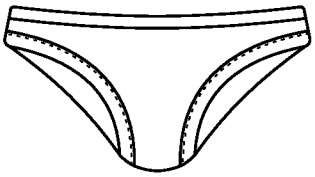
Figure 8H:
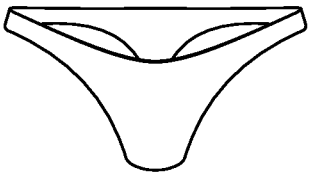
Figure 8I:
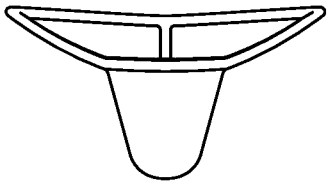
Figure 9A:
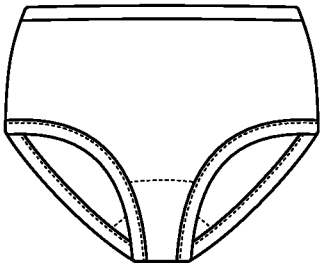
FIGS. 9A-9H illustrate some exemplary undergarments which may include the protective zones described.
Figure 9B:
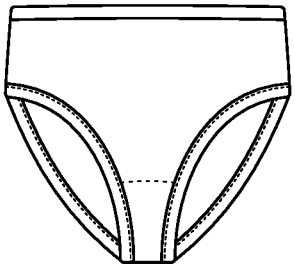
Figure 9C:
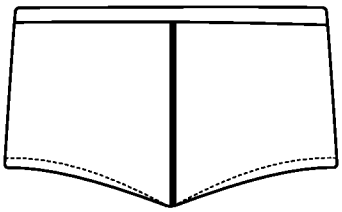
Figure 9D:
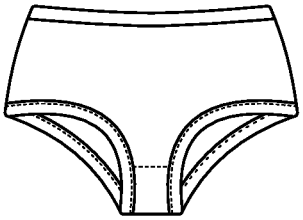
Figure 9E:
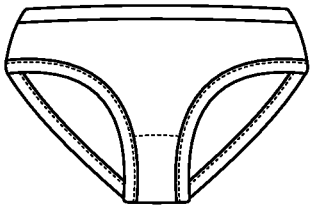
Figure 9F:
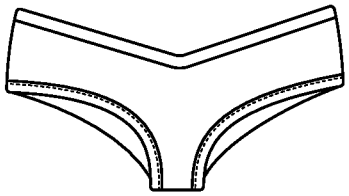
Figure 9G:
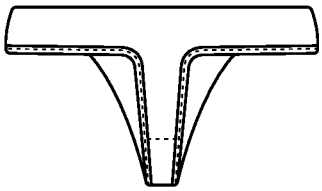
Figure 9H:
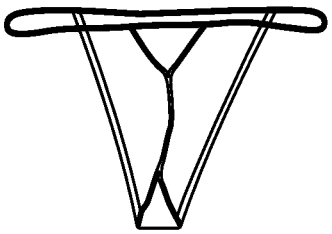

FIG. 6 is a front view of another embodiment of an underwear including a protective zone and an elongated waist area. FIG. 7 is a back view of one embodiment of the underwear of FIG. 6. As can be seen, the elongated waist area 610 provides additional compression and sweat protection across the stomach and the lower back. Two of the most common areas of sweat accumulation are the stomach and lower back. Furthermore, in one embodiment the elongated waist area may be provided with additional elastic to improve the appearance of the wearer. In one embodiment, the elongated waist area 610 is made entirely of the sweat proof material. In another embodiment, the elongated waist may have one or more insets of sweat proof material. For example, the sides and lower back may be made with the sweat proof material, while the remaining areas are made with fabric designed to provide compression. The areas of sweat proof material are designed to cover those portions of the user's body which produce sweat, and which are likely to lead to sweat stains and/or odor.

FIGS. 8A-8I illustrate some exemplary men's undergarments which may include the protective zones described. FIGS. 9A-9H illustrate some exemplary women's undergarments which may include the protective zones described. Though the above description addresses a men's boxer brief style underwear, it should be apparent to one of skill in the art that the format of the garment is irrelevant. Though smaller garments provide a smaller area of protection, users can choose garments that protect the areas of concern for them. Thus, any configuration of underwear may be provided with one or more sweat-curtailing areas.

Figure 10:
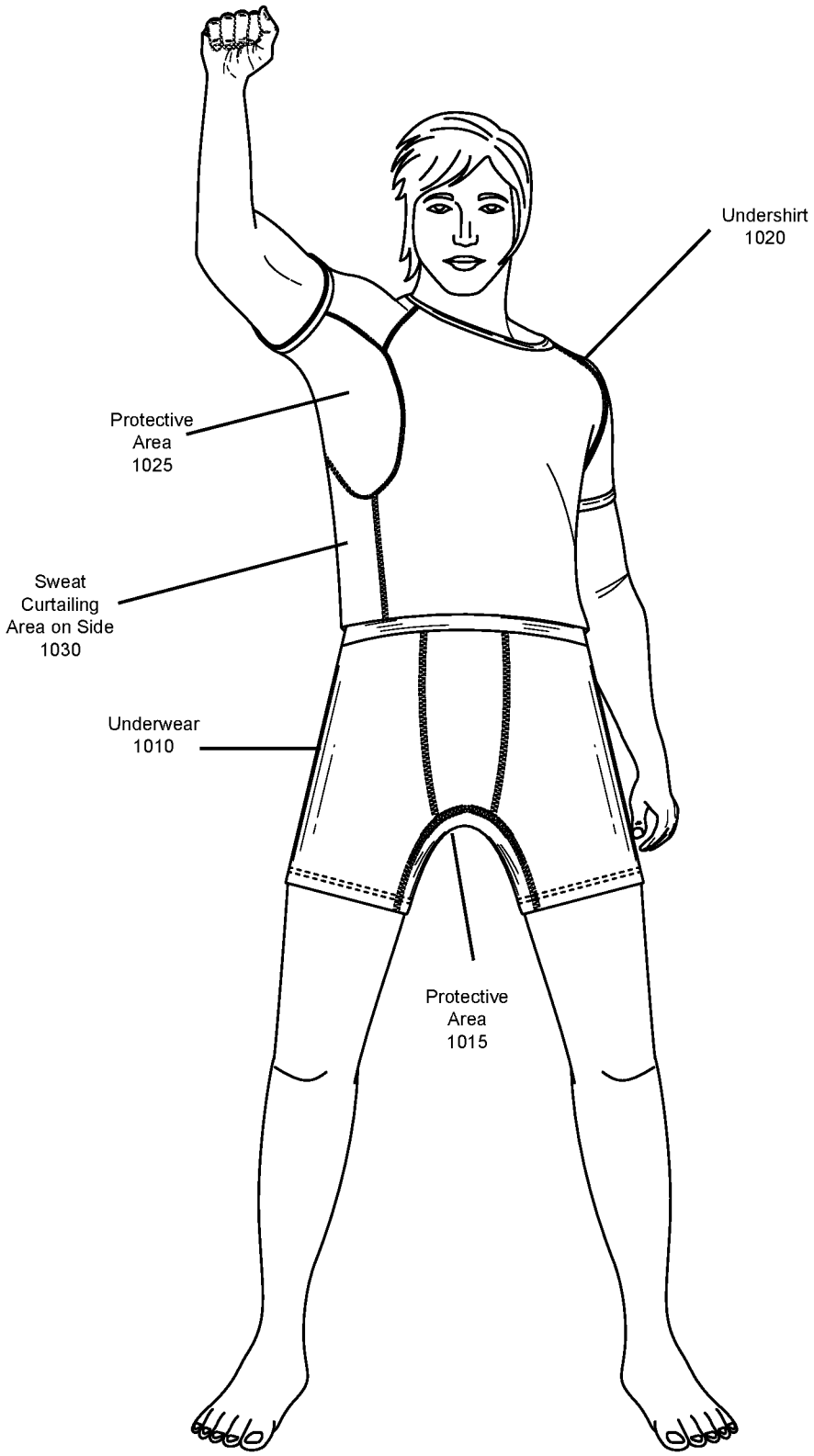
FIG. 10 illustrates an undergarment set, including underwear and undershirt, including the protective areas indicated.

Additionally, the underwear may be paired with an undershirt, to provide whole body coverage. FIG. 10 illustrates an undergarment set, including underwear 1010 and undershirt 1020. In this example, both the underwear 1010 and the under shirt 1020 include the protective areas 1015, 1025 indicated. In one embodiment, for an undershirt, the areas of sweat-curtailing areas 1025 include large patches at the armpit as shown. In one embodiment, the undershirt may also include a sweat-curtailing area in the upper back, between the shoulder blades (not shown). In one embodiment, the undershirt may also include a sweat-curtailing area on the sides. In one embodiment, the undershirt may also include a sweat-curtailing area on the lower back (not shown). In one embodiment, the undershirt may have a long tail, so that it can be tucked into a non-sweat-curtailing underwear, and provide protection on the lower back area.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

I claim:

1. An undergarment comprising:

a waist band;

a fabric material circling a waist of a wearer and splitting to create two short legs for covering an upper part of the wearer's legs defining the undergarment;

a crotch pouch;

a multi-layer sweat-curtailing portion between layers of the fabric material, for covering inner thighs between the wearer's legs, a center of buttocks area, a back of an upper part of the wearer's legs, the sweat-curtailing portion comprising absorbent material and water proof material;

wherein the resulting undergarment is flexible and adapted to conform to a body of the wearer, and provides curtailing of sweat.

2. The undergarment of claim 1, wherein the fabric material comprises micro modal fabric which is fused with an antibacterial material to kill bacteria to eliminate smells.

3. The undergarment of claim 2, wherein the antibacterial material comprises one of: silver, copper, and cationic polymer.

4. The undergarment of claim 1, further comprising:

an extended waist portion extending to mid-torso, the extended waist portion adapted to conform to the body of the wearer.

5. The undergarment of claim 4, wherein a center back portion of the extended waist portion includes the multi-layer sweat-curtailing portion.

6. The undergarment of claim 1, wherein the sweat-curtailing portion covering the inner thighs does not have seams.

7. The undergarment of claim 1, wherein an exterior examination of the undergarment does not make the multi-layer sweat-curtailing portions apparent.

8. The undergarment of claim 1, wherein an area of the underwear including the multi-layer sweat-curtailing portion comprises three-layers:

an exterior layer of fabric;

an absorbing inner layer impregnated with antibacterial material; and an intermediate sweat blocking waterproof layer.

9. The undergarment of claim 8, wherein the exterior layer of fabric is micro modal.

10. The undergarment of claim 8, wherein the waterproof layer comprises polyurethane laminate fabric.

11. A protective undergarment having a crotch portion, a waist portion, a front belly portion and a rear back portion, and extended leg portions having an inner thigh area and an outer thigh area, the undergarment comprising:

a fabric material defining the protective undergarment; and a multi-layer sweat-curtailing portion extending along a part of the fabric material, covering the inner thigh area, a center of the rear back portion, and an upper part of the extended leg portions, the sweat-curtailing portion including absorbent material and water proof material, to result in the protective undergarment that is flexible and adapted to conform to a body of a wearer, and provides curtailing of sweat.

12. The undergarment of claim 11, wherein the fabric material comprises micro modal fabric which is fused with an antibacterial material to kill bacteria to eliminate smells.

13. The undergarment of claim 12, wherein the antibacterial material comprises one of: silver, copper, and cationic polymer.

14. The undergarment of claim 11, wherein the sweat-curtailing portion covering the inner thigh area does not have seams.

15. The undergarment of claim 11, wherein an exterior examination of the undergarment does not make the absorbent portions apparent.

16. The undergarment of claim 11, wherein an area of the undergarment including the sweat-curtailing portion comprises three-layers:

an exterior layer of fabric;

an absorbing inner layer impregnated with antibacterial material; and an intermediate sweat blocking waterproof layer.

17. The undergarment of claim 16, wherein the exterior layer of fabric is micro modal.

18. The undergarment of claim 16, wherein the waterproof layer comprises polyurethane laminate fabric.

19. The undergarment of claim 11, comprising:

an extended waist portion extending to mid-torso, the extended waist portion adapted to conform to the body of the wearer.

20. The undergarment of claim 19, wherein a center back portion of the extended waist portion includes the multi-layer sweat-curtailing portion.

* * * * *